US005141275A

United States Patent [19]

Walsh et al.

[11] Patent Number: 5,141,275

[45] Date of Patent: Aug. 25, 1992

[54] DRILL ROD RETRIEVAL DEVICE

[76] Inventors: David H. Walsh; Charles B. Walsh, both of Box 3446 23191 Fraser Hwy., Langley, Canada, V3A 4R8

[21] Appl. No.: 830,962

[22] Filed: Feb. 5, 1992

Related U.S. Application Data

[63] Continuation of Ser. No. 510,649, Apr. 18, 1990, abandoned.

[51] Int. Cl.[5] ..... E21B 31/20

[52] U.S. Cl. ..... 294/86.22; 294/86.1; 294/86.13

[58] Field of Search ..... 294/86.1, 86.12, 86.13, 294/86.22, 86.24, 86.25, 86.34; 166/178

[56] References Cited

U.S. PATENT DOCUMENTS 2,305,709 12/1942 Johnson ..... 294/86.22
2,912,273 11/1959 Chadderdon et al. ..... 294/86.34
2,955,655 10/1960 Ware ..... 294/86.34
3,737,189 6/1973 Darby ..... 294/86.34
4,681,175 7/1987 Bocking et al. ..... 294/86.22

*Primary Examiner*—Margaret A. Focarino
*Assistant Examiner*—Dean J. Kramer
*Attorney, Agent, or Firm*—Townsend and Townsend

[57] ABSTRACT

A drill rod retrieval device for recovering hollow drill rods that are connectable end to end by coupling means from a drill shaft. The device comprises an internally threaded female section formed within the hollow interior of each of the drill rods and a retrieval member comprising a threaded male member adapted to be inserted down the drill shaft and engaged in the internally theaded female section of an uppermost drill rod. The rod and the retrieval member are threadably engaged one with the other whereupon the retrieval member is removed from the drill shaft with the uppermost drill rod and any additional drill rods connected to the uppermost drill rod.

9 Claims, 1 Drawing Sheet

DRILL ROD RETRIEVAL DEVICE

This is a continuation of application Ser. No. 07/510,649 filed Apr. 18, 1990, now abandoned.

FIELD OF THE INVENTION

This invention relates to a drill rod retrieval device, and is particularly suited, but not limited, to a device for retrieving a drill rod below a break in the drill rod.

BACKGROUND OF THE INVENTION

Drill holes or shafts are employed in prospecting for minerals such as oil or water and for bringing them to the surface. Continuous rotary drilling is the preferred drilling technique as it allows for drilling to substantial depths with reasonably rapid drilling progress. In this drilling technique, drill rods are suspended from a pulley block within a support structure such as a drilling derrick. A power-driven turntable transmits rotary motion to the drill rods and thus to a drill bit attached by screw threads to the lowermost drill rod. As the drill shaft gets deeper additional drill rods are coupled to those already in the ground to extend the overall length of the drill. U.S. Pat. No. 1,019,707 to wilcox and U.S. Pat. No. 2,454,137 to Claypool et al. show coupling means that can be used to interconnect the various drill rods together. Generally, the drill rods comprise identical hollow elongate members having appropriate coupling means at each end to allow the rods to be joined together. During drilling, a flushing liquid known as drilling mud is pumped down the hollow interior of the rods and then rises to the surface through the annular space between the drill rods and the drill shaft walls. The mud serves to cool the drill and keep the drill bit free of obstructing material by washing away drilled material and carrying it to the surface. Air is also used in place of the mud to blow drilled material from the drilling area.

unfortunately, during continuous rotary drilling, it is not unknown for a drill rod to break due to the large twisting forces that the rods are subjected to. When such a break occurs, it is necessary to remove the intact rods above the break and introduce a gripping tool to fish about in the drill shaft for the broken end of the rod. It is desirable to remove the drill rods below the break as quickly as possible otherwise the drilling mud which is no longer being circulated through the drill shaft and the drilled material tends to dry out and cement the broken drill rods and attached bit in the drill shaft.

U.S. Pat. No. 1,075,896 to Boughner discloses a drill rod connection that employs a central cable extending through the entire length of the hollow interior of the drill rod to allow broken pieces of the drill rod to be quickly recovered. However, the design of Boughner slows down the process of coupling the drill rods since additional connections must be made at each joint to connect the individual cables that make up the central cable together.

U.S. Pat. No. 4,047,568 to Aulenbacher shows an apparatus for retrieving casing from a well shaft that has been permanently mounted in place to stabilize the walls of the shaft after drilling. The apparatus includes a cutting mechanism for severing the casing wall prior to removing it and relies on an outwardly expanding element of some complexity that is wedged in place within the casing to grasp and retrieve the cut section of casing.

SUMMARY OF THE INVENTION

Therefore, there exists a need for a drill rod retrieval device that is simple in structure and allows for quick recovery of drill rods from a shaft, but does not involve additional time and effort when coupling together the drill rods.

Accordingly, the present invention provides a drill rod retrieval device for recovering hollow drill rods that are connectable end to end by coupling means from a drill shaft, the device comprising:

an internally threaded female section formed within the hollow interior of each of the drill rods;

retrieval member comprising a threaded male member adapted to be inserted down the drill shaft and engaged in the internally threaded female section of an uppermost drill rod to releasably interlock the rod and the retrieval member whereupon the retrieval member is removed from the drill shaft with the uppermost drill rod and any additional drill rods connected to the uppermost drill rod.

Additionally, the device of the present invention includes an aligning device for aligning the retrieval member with the female section in a drill rod that is out of alignment with the central axis of the drill shaft.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
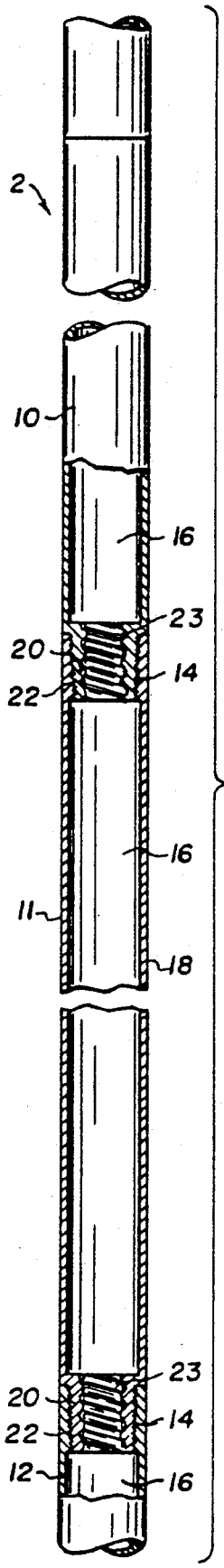
FIG. 1 is a partially sectioned view showing a series of interconnected drill rods having internally threaded female sections.

FIG. 1 shows a plurality of drill rods 10, 11 and 12 that are coupled together end to end at coupling means 14 to form a drilling member 2 for drilling a shaft. The drill rods are hollow metal members having an interior 16 and an exterior 18. The lowermost drill rod is attached to a drill bit (not shown) that does the actual drilling into the ground. Drilling mud is pumped through interior 16 of the drill rods.

Coupling means 14 employs a tapered externally threaded male member 20 at a lower end of an upper drill rod engagable in a correspondingly tapered internally threaded female member 22 at an upper end of a lower drill rod.

As shown in cross-section in FIG. 1, an internally threaded female section 23 is formed within the hollow interior 16 of each of the drill rods. In the illustrated embodiment, female section 23 is formed as an internal portion of the male coupling member 20. However, it will be apparent that female section 23 can be formed at any location within the hollow interior 16 of a drill rod.

Female section 23 allows for passage of drilling mud through the hollow interior.

Figure 2:
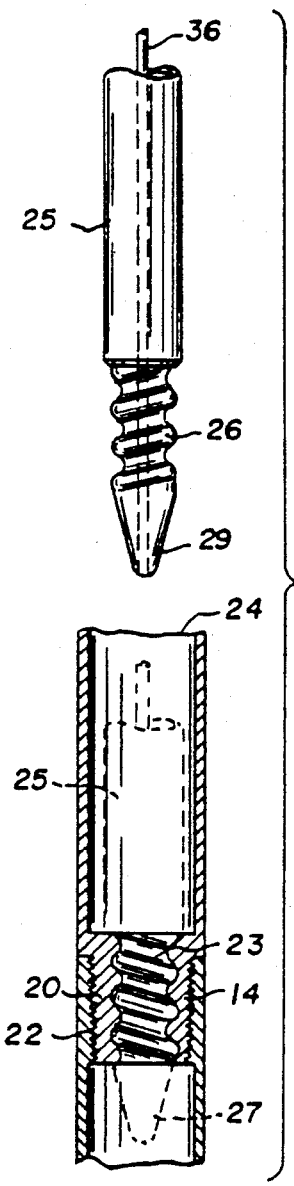
FIG. 2 is a partially sectioned view showing the manner in which the retrieval member is engaged in the internally threaded female section.

FIG. 2 illustrates the manner in which the present invention is used if a break 24 should occur in one of the drill rods. It is first necessary to remove the drill rods above the break in a conventional manner by hoisting up the drill rods and de-coupling them from each other as each rod is removed from the drill shaft. A retrieval member 25 according to the present invention is then introduced down the drill shaft. The retrieval member comprises a threaded male member 26 for engaging in the internally threaded female section 23 of the uppermost drill rod of the portion of the drill member 2 still left in the drill shaft below the break. Male member 26 is attached to the end of a series of drill rods. Male member 26 is threadedly engaged in female section 23 as shown by dashed lines 27 to releasably interlock the uppermost drill rod below the break and the retrieval member together. When the retrieval member is removed from the drill shaft the uppermost drill rod and any additional lower attached drill rods are also removed.

In order to aid insertion of male member 26 into female section 23, the male member can be formed with a conical tip 29. The member 25 has a pipe 36 to allow blowing of air through the drill shaft to the drilling point and air is blown down pipe 36 as soon as member 26 engages female section 23 to keep the drill hole clear.

In certain instances the alignment of the male retrieval member and the female section will be such that the male member 26 cannot be introduced into the female section. For example, the drill rods left in the drill shaft below the break will tend to slump sideways against the wall of the drill shaft causing the opening to the female section to move off centre with respect to the central axis of the drill shaft. Due to gravity, male member 26 will tend to be aligned along the central axis of the drill shaft so that engagement of the male member and the off centre female section will be difficult.

Figure 3:
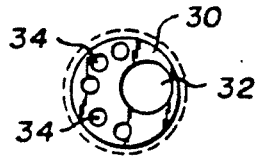
FIG. 3 is a plan view of the aligning device of the present invention.

To address the foregoing problem, the present invention includes an aligning device, shown in plan view in FIG. 3, for aligning the male member with the female section in a drill rod that is out of alignment with the central axis of the drill shaft. The alignment device comprises a cylindrical member 30 having a diameter corresponding essentially to the diameter of the drill shaft and dimension for slidable movement up and down the axis of the drill shaft. An off-centre opening 32 extends through member 30 parallel to the axis of the cylindrical member. Off-centre opening 32 is dimensioned to slidably accept retrieval member 25. When retrieval member 25 is lowered down a drill shaft in association with cylindrical member 30, the retrieval member is constrained to move down the drill shaft along an axis parallel to but spaced from the axis of the drill shaft. Therefore, the retrieval member is moved down the drill shaft adjacent the walls of the shaft rather than the central axis to greatly increase the chance of engaging a drill rod that is slumped against a side wall of the shaft.

Member 32 is preferably flexible, for example of neoprene, and may be attached to member 25 by grub screws extending through a flange on member 32 to contact retrieval member 25.

Necessarily, means for rotating the aligning device are provided in order to position the retrieval member 25 directly above a drill rod out of alignment with the central axis of the drill shaft. In a preferred embodiment, these means comprise a plurality of smaller off centre openings 34 arranged about larger off centre opening 32. Opening 34 accept a longitudinal member that is extended down the drill shaft. The longitudinal member can then be used to rotate cylindrical member 30 and hence retrieval member 25 to any desired angle to allow for precise alignment of the retrieval member and the broken end of the drill member.

Figure 4:
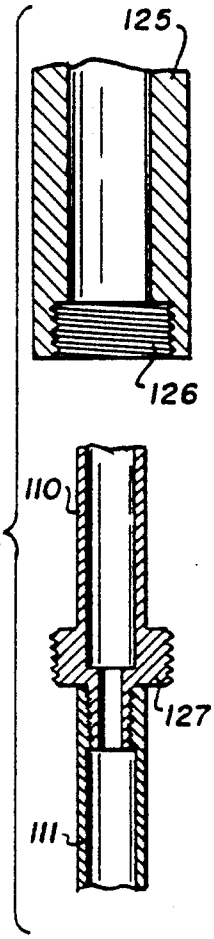
FIG. 4 illustrates a further embodiment of the present invention.

FIG. 4 shows an aspect of the invention useful with small diameter drill rods, for example what are known as air track rock drills, typically used in the drilling of domestic wells, for example water wells.

In this embodiment a retrieval member 125 has an internal coarse thread at 126 and the drilling rods 110 and 111, which are joined together in the same way as in FIG. 1, have an external thread 127 to engage the retrieving member. The use of this embodiment of the invention is precisely as described for the preceding embodiment.

The present invention thus provides a simple and, in particular, rapid method of retrieving a drill rod from a drill hole. The simplicity of the threaded engagement, particularly as the thread is desirably coarse, means that the threaded members can easily engage in the shortest possible time.

Although the present invention has been described in some detail by way of example for purposes of clarity and understanding, it will be apparent that certain changes and modifications may be practiced within the scope of the appended claims.

We claim:

1. A drill rod retrieval combination adapted to facilitate recovery of a drill string made of a plurality of drill rods in the event of breakage of said string in a drill shaft, said combination comprising:

a tubular drill rod having a hollow interior and formed at each end with coupling means to attach the rod to like drill rods to form a drill string;

an internally threaded female section within the hollow interior of the drill rod, separate from said coupling means and playing no part in coupling said plurality of drill rods, a retrieval member comprising a threaded male member adapted to be inserted down said drill shaft and engaged in the internally threaded female section of an uppermost drill rod to releasably interlock said rod and said retrieval member whereupon said retrieval member is removed from said drill shaft with the uppermost drill rod and any additional

2. A drill rod retrieval device as claimed in claim 1 in which said internal threaded section is formed adjacent said coupling means.

3. A drill rod retrieval device as claimed in claim 1 in which said retrieval member is formed with a conical tip to aid insertion into said internally threaded female section.

4. A drill rod retrieval device as claimed in claim 1 including an aligning device for aligning said retrieval member with said female section in a drill rod that is out of alignment with the central axis of said drill shaft.

5. A drill rod retrieval device as claimed in claim 4 in which said aligning device comprises a cylindrical member having an diameter corresponding essentially to the diameter of said drill shaft and adapted for slidable movement along the central axis of said drill shaft, an off centre opening extending through said member parallel to said central axis for slidably accepting said retrieval member and constraining said retrieval member for movement in said drill shaft along an axis parallel to and spaced from said central axis; means for rotating said aligning device in order to position said retrieval member above a drill rod out of alignment with the central axis of the drill shaft.

6. A drill rod retrieval device as claimed in claim 5 in which said means for rotating comprises a plurality of off centre openings arranged about said off centre opening for said retrieval member adapted to accept a longitudinal member extended down the drill shaft.

7. A drill rod retrieval device as claimed in claim 1 including a pipe extending downwardly through the hollow interior of the retrieval member to allow the blowing of air through the retrieval member into the hollow drill rods.

8. A drill rod retrieval combination adapted to facilitate recovery of a drill string made of a plurality of drill rods in the event of breakage of said string in a drill shaft, said combination comprising;

a tubular drill rod having a hollow interior and formed at each end with coupling means to attach the rod to like drill rods to form a drill string;

a threaded section on each drill rod separate from said coupling means and playing no part in coupling said plurality of drill rods;

a retrieval member comprising a threaded member adapted to be insertd down said drill shaft and engaged with the threaded section of an uppermost drill rod to releasably interlock said rod and said retrieval member whereupon said retrieval member to removed from said drill shaft with the uppermost drill rod and any additional drill rods connected to said uppermost drill rod.

9. A drill rod retrieval device as claimed in claim 8 in which the retrieval member is a tube formed with an internal thread adjacent one end and the drill rod is formed with an external threaded section with a corresponding thread.

* * * * *